US008973545B2

(12) United States Patent
Kawada et al.

(10) Patent No.: US 8,973,545 B2
(45) Date of Patent: Mar. 10, 2015

(54) VALVE-TIMING CONTROL APPARATUS FOR INTERNAL COMBUSTION ENGINE

(71) Applicant: Hitachi Automotive Systems, Ltd., Hitachinaka (JP)

(72) Inventors: Shinichi Kawada, Isehara (JP); Ryo Tadokoro, Atsugi (JP); Atsushi Yamanaka, Atsugi (JP)

(73) Assignee: Hitachi Automotive Systems, Ltd., Ibaraki (JP)

( * ) Notice: Subject to any disclaimer, the term of this patent is extended or adjusted under 35 U.S.C. 154(b) by 0 days.

(21) Appl. No.: 14/107,477

(22) Filed: Dec. 16, 2013

(65) Prior Publication Data

US 2014/0165938 A1 Jun. 19, 2014

(30) Foreign Application Priority Data

Dec. 18, 2012 (JP) ..... 2012-275226

(51) Int. Cl.
*F01L 1/34* (2006.01)

(52) U.S. Cl.
CPC ..... *F01L 1/34* (2013.01); *F01L 2820/032* (2013.01)
USPC ..... 123/90.17; 123/90.15

(58) Field of Classification Search
USPC ..... 123/90.15, 90.17
See application file for complete search history.

(56) References Cited

U.S. PATENT DOCUMENTS 4,561,390 A * 12/1985 Nakamura et al. ..... 123/90.15

FOREIGN PATENT DOCUMENTS

JP 2011-256798 A 12/2011

OTHER PUBLICATIONS

U.S. Appl. No. 14/107,519, filed Dec. 16, 2013, Hitachi Automotive Systems, Inc.

* cited by examiner

*Primary Examiner* — Zelalem Eshete
(74) *Attorney, Agent, or Firm* — Foley & Lardner LLP

(57) ABSTRACT

A valve-timing control apparatus includes a drive rotating member; a driven rotating member fixed to a cam shaft; an electric motor configured to rotate the driven rotating member relative to the drive rotating member; a motor housing connected integrally with the drive rotating member; a cover member located to face a front portion of the housing; a tubular motor output shaft provided inside the housing to be rotatable relative to the housing; and a plug member fixed to an inner circumferential surface of a tip portion of the tubular motor output shaft and configured to inhibit lubricating oil supplied into the tubular motor output shaft from leaking to an external. The plug member includes a core member formed in a bottomed tubular shape and formed with a through-hole in its bottom portion, and an elastic body coating at least the through-hole and an outer circumferential surface of the core member.

12 Claims, 8 Drawing Sheets

VALVE-TIMING CONTROL APPARATUS FOR INTERNAL COMBUSTION ENGINE

BACKGROUND OF THE INVENTION

The present invention relates to a valve-timing control apparatus for an internal combustion engine, in which opening and closing timings of intake valve and/or exhaust valve of the internal combustion engine are controlled.

Recently, a valve-timing control apparatus is proposed in which opening and closing timings of intake or exhaust valve are controlled by transmitting rotative force of an electric motor through a speed-reduction mechanism to a cam shaft and thereby varying a relative rotational phase of the cam shaft to a sprocket to which rotative force is transmitted from a crankshaft.

Japanese Patent Application Publication No. 2011-256798 discloses a previously-proposed valve-timing control apparatus. In this technique, an output shaft of the electric motor is formed in a tubular shape, and a bearing member such as a ball bearing is accommodated inside the tubular output shaft. Accordingly, an axial length of the entire valve-timing control apparatus can be shortened to attain a downsizing thereof. The bearing member is lubricated by supplying lubricating oil into the tubular output shaft.

Moreover, in the above previously-proposed valve-timing control apparatus, a brush is provided to a cover member located on a front end side of the electric motor whereas a slip ring is provided to the electric motor. By means of a contact between these brush and slip ring, electric power is supplied to the electric motor. A plug member is provided inside a tip portion of the tubular output shaft in order to prevent lubricating oil retained in the tubular output shaft from flowing out and adhering to the brush and the slip ring.

SUMMARY OF THE INVENTION

However, in the above previously-proposed valve-timing control apparatus, the plug member includes a core member which is made of a metal material in the form of "U" in cross section. A rubber material integrally coats (i.e., integrally molded to) an entire surface of the core member of the plug member. Hence, once the plug member has been fitted and fixed into the tubular output shaft by press fitting, it is difficult to detach the plug member. Therefore, for example, there is a problem that a maintenance for the inside of the tubular output shaft of the electric motor is not easily performed.

It is therefore an object of the present invention to provide a valve-timing control apparatus for an internal combustion engine, devised to easily detach the plug member even after the plug member has been fixed into the output shaft of the electric motor.

According to one aspect of the present invention, there is provided a valve-timing control apparatus for an internal combustion engine, comprising: a drive rotating member configured to receive a rotational force from a crankshaft; a driven rotating member fixed to a cam shaft and configured to rotate relative to the drive rotating member; an electric motor configured to rotate the driven rotating member relative to the drive rotating member by means of rotary drive of the electric motor; a housing connected integrally with the drive rotating member, wherein structural components of the electric motor are accommodated in the housing; a cover member fixed to a main body of the internal combustion engine and located to face a front end portion of the housing; a slip ring configured to supply electric power to the electric motor and provided to one of the front end portion of the housing and a facing portion of the cover member which faces the front end portion of the housing; a brush provided to another of the front end portion of the housing and the facing portion of the cover member, and configured to supply electric power to the electric motor by an electrical contact with the slip ring; a tubular motor output shaft provided inside the housing to be rotatable relative to the housing, and configured to be rotated by electric-power supply to the electric motor, wherein lubricating oil is supplied into the tubular motor output shaft; a bearing member provided between an outer circumferential surface of a part of the driven rotating member and an inner circumferential surface of the tubular motor output shaft; a plug member fixed to an inner circumferential surface of a tip portion of the tubular motor output shaft, the cover member facing the tip portion of the tubular motor output shaft, wherein the plug member is configured to inhibit lubricating oil supplied into the tubular motor output shaft from leaking to an external; and a seal member provided between the cover member and the housing and configured to inhibit lubricating oil from entering a gap between the slip ring and the brush, wherein the plug member includes a core member formed in a bottomed tubular shape having a through-hole in a bottom portion of the core member, and an elastic body coating at least the through-hole and an outer circumferential surface of the core member, the elastic body closing the through-hole.

According to another aspect of the present invention, there is provided a valve-timing control apparatus for an internal combustion engine, comprising: a drive rotating member configured to receive a rotational force from a crankshaft; a driven rotating member fixed to a cam shaft and configured to rotate relative to the drive rotating member; an electric motor configured to rotate the driven rotating member relative to the drive rotating member by means of rotary drive of the electric motor; a housing connected integrally with the drive rotating member, wherein structural components of the electric motor are accommodated in the housing; a cover member fixed to a main body of the internal combustion engine and located to face a front end portion of the housing; a slip ring configured to supply electric power to the electric motor and provided to one of the front end portion of the housing and a facing portion of the cover member which faces the front end portion of the housing; a brush provided to another of the front end portion of the housing and the facing portion of the cover member, and configured to supply electric power to the electric motor by an electrical contact with the slip ring; a tubular motor output shaft provided inside the housing to be rotatable relative to the housing, and configured to be rotated by electric-power supply to the electric motor, wherein lubricating oil is supplied into the tubular motor output shaft; a bearing member provided between an outer circumferential surface of a part of the driven rotating member and an inner circumferential surface of the tubular motor output shaft; a plug member fixed to an inner circumferential surface of a tip portion of the tubular motor output shaft, the cover member facing the tip portion of the tubular motor output shaft, wherein the plug member is configured to inhibit lubricating oil supplied into the tubular motor output shaft from leaking to an external; and a seal member provided between the cover member and the housing and configured to inhibit lubricating oil from entering a gap between the slip ring and the brush, wherein the plug member includes a core member formed in a bottomed cylindrical shape having a through-hole in a bottom portion of the core member, and a sealing structure configured to maintain a sealed state of the through-hole under a state where the lubricating oil supplied into the tubular motor output shaft takes a maximum pressure level thereof, and to release the sealed state of the through-hole when an axial force greater than the maximum pressure level of the lubricating oil is applied to the through-hole.

According to still another aspect of the present invention, there is provided a valve-timing control apparatus for an internal combustion engine, comprising: a drive rotating member configured to receive a rotational force from a crankshaft; a driven rotating member fixed to a cam shaft and configured to rotate relative to the drive rotating member; an electric motor configured to rotate the driven rotating member relative to the drive rotating member by means of rotary drive of the electric motor; a housing connected integrally with the drive rotating member, wherein structural components of the electric motor are accommodated in the housing; a cover member fixed to a main body of the internal combustion engine and located to face a front end portion of the housing; a slip ring configured to supply electric power to the electric motor and provided to one of the front end portion of the housing and a facing portion of the cover member which faces the front end portion of the housing; a brush provided to another of the front end portion of the housing and the facing portion of the cover member, and configured to supply electric power to the electric motor by an electrical contact with the slip ring; a tubular motor output shaft provided inside the housing to be rotatable relative to the housing, and configured to be rotated by electric-power supply to the electric motor, wherein lubricating oil is supplied into the tubular motor output shaft; a bearing member provided between an outer circumferential surface of a part of the driven rotating member and an inner circumferential surface of the tubular motor output shaft; a plug member fixed to an inner circumferential surface of a tip portion of the tubular motor output shaft, the cover member facing the tip portion of the tubular motor output shaft, wherein the plug member is configured to inhibit lubricating oil supplied into the tubular motor output shaft from leaking to an external; and a seal member provided between the cover member and the housing and configured to inhibit lubricating oil from entering a gap between the slip ring and the brush, wherein the plug member is formed in a bottomed cylindrical shape, and a bottom portion of the plug member has a rigidity lower than a rigidity of the other portion of the plug member.

The other objects and features of this invention will become understood from the following description with reference to the accompanying drawings.

DETAILED DESCRIPTION OF THE INVENTION

Figure 1:
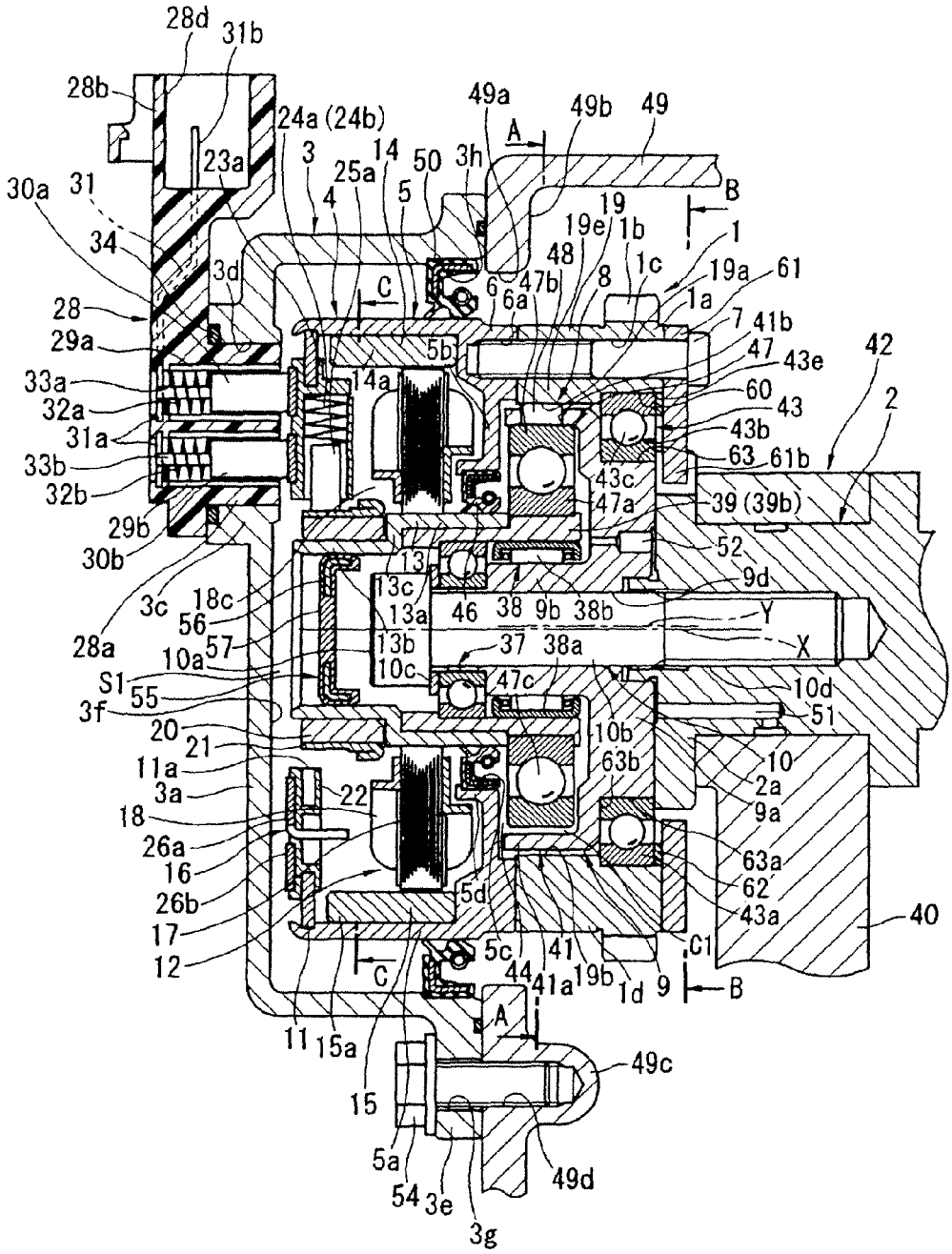
FIG. 1 is a longitudinal sectional view of a valve-timing control apparatus in a first embodiment according to the present invention.

Hereinafter, embodiments of valve-timing control (VTC) apparatus for an internal combustion engine according to the present invention will be explained referring to the drawings.

First Embodiment

Figure 2:
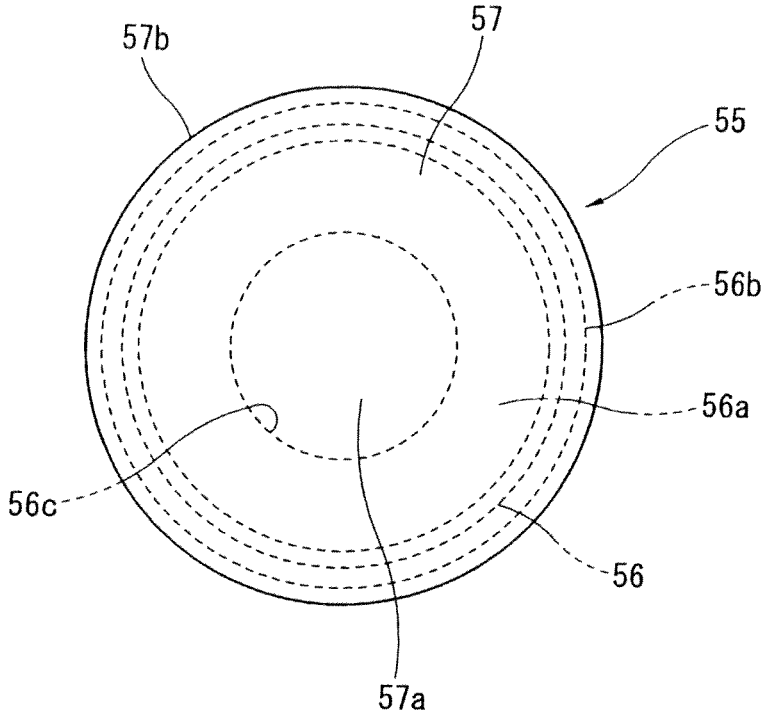
FIG. 2 is a front view of a plug member in the first embodiment.
Figure 3:
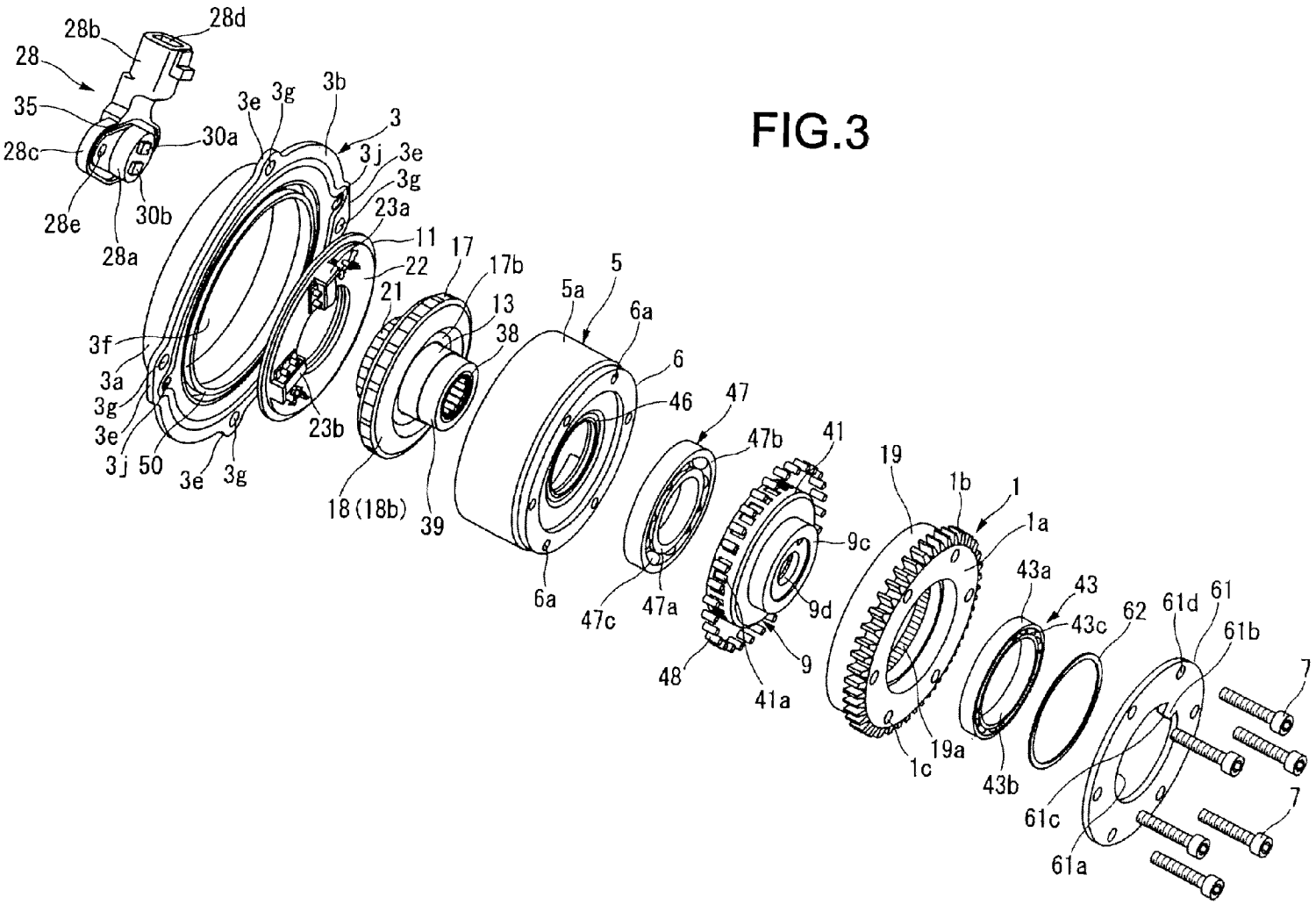
FIG. 3 is an exploded oblique perspective view showing structural elements in the first embodiment.

As shown in FIGS. 1 to 3, a valve-timing control apparatus includes a timing sprocket 1, a cam shaft 2, a cover member 3 and a phase change mechanism 4. The timing sprocket 1 (functioning as a drive rotating member) is rotated and driven by a crankshaft of the internal combustion engine. The cam shaft 2 is rotatably supported on a cylinder head 40 through a bearing 42, and is rotated by a rotational force transmitted from the timing sprocket 1. The cover member 3 is provided on a front side (in an axially frontward direction) of the timing sprocket 1, and is fixedly attached to a chain cover 49. The phase change mechanism 4 is provided between the timing sprocket 1 and the cam shaft 2, and is configured to change a relative rotational phase between the timing sprocket 1 and the cam shaft 2 in accordance with an operating state of the engine.

Whole of the timing sprocket 1 is integrally formed of an iron-based metal in an annular shape. The timing sprocket 1 includes a sprocket main body 1*a*, a gear portion 1*b* and an internal-teeth constituting portion (internal-gear portion) 19. An inner circumferential surface of the sprocket main body 1*a* is formed in a stepped shape to have two relatively large and small diameters as shown in FIG. 1. The gear portion 1*b* is formed integrally with an outer circumference of the sprocket main body 1*a*, and receives rotational force through a wound timing chain (not shown) from the crankshaft. The internal-teeth constituting portion 19 is formed integrally with a front end portion of the sprocket main body 1*a*.

A large-diameter ball bearing 43 which is a bearing having a relatively large diameter is interposed between the sprocket main body 1*a* and an after-mentioned follower member 9 provided on a front end portion of the cam shaft 2. The timing sprocket 1 is rotatably supported by the cam shaft 2 through the large-diameter ball bearing 43 such that a relative rotation between the cam shaft 2 and the timing sprocket 1 is possible.

The large-diameter ball bearing 43 includes an outer race 43*a*, an inner race 43*b*, and a ball(s) 43*c* interposed between the outer race 43*a* and the inner race 43*b*. The outer race 43*a* of the large-diameter ball bearing 43 is fixed to an inner circumferential portion (i.e., inner circumferential surface) of the sprocket main body 1*a* whereas the inner race 43*b* of the large-diameter ball bearing 43 is fixed to an outer circumferential portion (i.e., outer circumferential surface) of the follower member 9.

The inner circumferential portion of the sprocket main body 1*a* is formed with an outer-race fixing portion 60 which is in an annular-groove shape as obtained by cutting out a part of the inner circumferential portion of the sprocket main body 1*a*. The outer-race fixing portion 60 is formed to be open toward the cam shaft 2.

The outer-race fixing portion 60 is formed in a stepped shape to have two relatively large and small diameters. The outer race 43*a* of the large-diameter ball bearing 43 is fitted into the outer-race fixing portion 60 by press fitting in an axial direction of the timing sprocket 1. Thereby, one axial end of the outer race 43*a* is placed at a predetermined position, that is, a positioning of the outer race 43*a* is performed.

The internal-teeth constituting portion 19 is formed integrally with an outer circumferential side of the front end portion of the sprocket main body 1*a*. The internal-teeth constituting portion 19 is formed in a cylindrical shape (circular-tube shape) extending in a direction toward an electric motor 12 of the phase change mechanism 4. An inner circumference of the internal-teeth constituting portion 19 is formed with internal teeth (internal gear) 19*a* which function as a wave-shaped meshing portion.

Moreover, a female-thread constituting portion 6 formed integrally with an after-mentioned housing 5 is placed to face a front end portion of the internal-teeth constituting portion 19. The female-thread constituting portion 6 is formed in an annular shape.

Moreover, an annular retaining plate 61 is disposed on a (axially) rear end portion of the sprocket main body 1*a*, on the side opposite to the internal-teeth constituting portion 19. This retaining plate 61 is integrally formed of metallic sheet material. As shown in FIG. 1. An outer diameter of the retaining plate 61 is approximately equal to an outer diameter of the sprocket main body 1*a*. An inner diameter of the retaining plate 61 is approximately equal to a diameter of a radially center portion of the large-diameter ball bearing 43.

Therefore, an inner circumferential portion 61*a* of the retaining plate 61 faces and covers an axially outer end surface 43*e* of the outer race 43*a* through a predetermined clearance. Moreover, a stopper convex portion 61*b* which protrudes in a radially-inner direction of the annular retaining plate 61, i.e. protrudes toward a central axis of the annular retaining plate 61 is provided at a predetermined location of an inner circumferential edge (i.e., radially-inner edge) of the inner circumferential portion 61*a*. This stopper convex portion 61*b* is formed integrally with the inner circumferential portion 61*a*.

Figure 5:
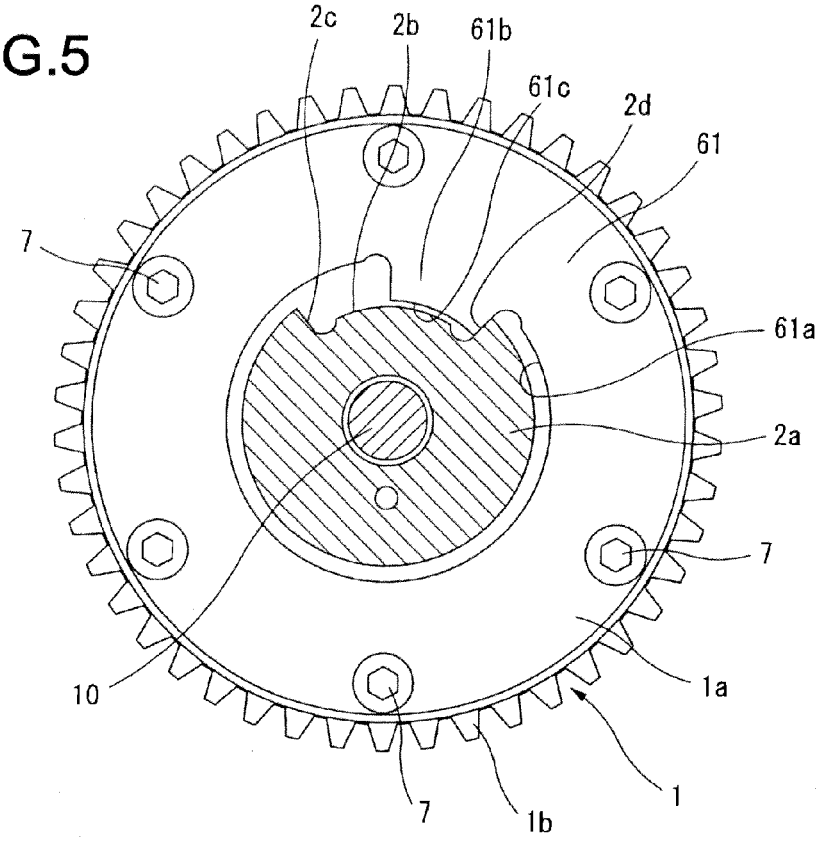
FIG. 5 is a sectional view of FIG. 1, taken along a line B-B.

As shown in FIGS. 1 and 5, the stopper convex portion 61*b* is formed in a substantially fan shape. A tip edge 61*c* of the stopper convex portion 61*b* is formed in a circular-arc shape in cross section, along a circular-arc-shaped inner circumferential surface of an after-mentioned stopper groove 2*b*. Moreover, an outer circumferential portion of the retaining plate 61 is formed with six bolt insertion holes 61*d* each of which passes through the retaining plate 61. The six bolt insertion holes 61*d* are formed at circumferentially equally-spaced intervals in the outer circumferential portion of the retaining plate 61. A bolt 7 is inserted through each of the six bolt insertion holes 61*d*.

An annular spacer 62 is interposed between an axially inner surface of the retaining plate 61 and the outer end surface 43*e* of the outer race 43*a* of the large-diameter ball bearing 43. Thereby, the inner surface of the retaining plate 61 faces the outer end surface 43*e* through the annular spacer 62. By this spacer 62, the inner surface of the retaining plate 61 applies a slight pressing force to the outer end surface 43*e* of the outer race 43*a* when the retaining plate 61 is jointly fastened to the timing sprocket 1 and the housing 5 by the bolts 7. However, a thickness of the spacer 62 is set at a certain degree at which a minute clearance between the outer end surface 43*e* of the outer race 43*a* and the retaining plate 61 is produced within a permissible range for an axial movement of the outer race 43*a*.

An outer circumferential portion of the sprocket main body 1*a* (the internal-teeth constituting portion 19) is formed with six bolt insertion holes 1*c* each of which axially passes through the timing sprocket 1*a*. The six bolt insertion holes 1*c* are formed substantially at circumferentially equally-spaced intervals in the outer circumferential portion of the sprocket main body 1*a*. Moreover, the female-thread constituting portion 6 is formed with six female threaded holes 6*a* at its portions respectively corresponding to the six bolt insertion holes 1*c* and the six bolt insertion holes 61*d*. By the six bolts 7 inserted into the six bolt insertion holes 61*d*, the six bolt insertion holes 1*c* and the six female threaded holes 6*a*; the timing sprocket 1*a*, the retaining plate 61 and the housing 5 are jointly fastened to one another from the axial direction.

It is noted that the sprocket main body 1*a* and the internal-teeth constituting portion 19 function as a casing for an after-mentioned speed-reduction mechanism 8.

The timing sprocket 1*a*, the internal-teeth constituting portion 19, the retaining plate 61 and the female-thread constituting portion 6 have outer diameters substantially equal to one another.

As shown in FIG. 1, the chain cover 49 is fixed to a front end portion of a cylinder block and the cylinder head 40 which constitute a main body of the engine. The chain cover 49 is disposed along an upper-lower direction to cover a chain (not shown) wound around the timing sprocket 1*a*. The chain cover 49 is formed with an opening portion 49*a* at a location corresponding to the phase change mechanism 4, and includes an annular wall 49*b*. The annular wall 49*b* constituting the opening portion 49*a* is formed with four boss portions 49*c*. The four boss portions 49*c* are formed integrally with the annular wall 49*b* and are located at circumferential four spots of the annular wall 49*b*. A female threaded hole 49*d* is formed in the annular wall 49*b* and each boss portion 49*c* to pass through the annular wall 49*b* and reach an interior of the each boss portion 49*c*. That is, four female threaded holes 49*d* corresponding to the four boss portions 49*c* are formed.

As shown in FIGS. 1 and 3, the cover member 3 is made of aluminum alloy material and is integrally formed in a cup shape. The cover member 3 includes a cover main body 3*a* and a mounting flange 3*b*. The cover main body 3*a* bulges out in the cup shape (protrudes in an expanded state) frontward in the axial direction. The mounting flange 3*b* is in an annular shape (ring shape) and is formed integrally with an outer circumferential edge of an opening-side portion of the cover main body 3*a*. The cover main body 3*a* is provided to face and cover a front end portion of the housing 5. An outer circumferential portion of the cover main body 3*a* is formed with a cylindrical wall 3*c* extending in the axial direction. The cylindrical wall 3*c* is formed integrally with the cover main body 3*a* and includes a retaining hole 3*d* therein. An inner circumferential surface of the retaining hole 3*d* functions as a guide surface for an after-mentioned brush retaining member 28.

The mounting flange 3*b* includes four boss portions 3*e*. The four boss portions 3*e* are formed substantially at circumferentially equally-spaced intervals (approximately at every 90-degree location) on the mounting flange 3*b*. Each boss portion 3*e* is formed with a bolt insertion hole 3*g*. The bolt insertion hole 3*g* passes through the boss portion 3*e*. Each bolt 54 is inserted through the bolt insertion hole 3*g* and is screwed in the female threaded hole 49*d* formed in the chain cover 49. By these bolts 54, the cover member 3 is fixed to the chain cover 49.

As shown in FIGS. 1 and 3, an oil seal 50 which is a seal member having a large diameter is interposed between an outer circumferential surface of the housing 5 and an inner circumferential surface of a stepped portion (multilevel portion) of outer circumferential side of the cover main body 3*a*. The large-diameter oil seal 50 is formed in a substantially U-shape in cross section, as shown in FIG. 1. A core metal is buried inside a base material formed of synthetic rubber. An annular base portion of outer circumferential side of the large-diameter oil seal 50 is fixedly fitted in a stepped annular portion (annular groove) 3*h* formed in the inner circumferential surface of the cover member 3.

The housing 5 includes a housing main body (tubular portion) 5*a* and a sealing plate 11. The housing main body 5*a* is formed in a tubular shape having its bottom by press molding. The housing main body 5*a* is formed of iron-based metal. The sealing plate 11 is formed of non-magnetic synthetic resin, and seals a front-end opening of the housing main body 5*a*.

The housing main body 5*a* includes a bottom portion 5*b* at a rear end portion of the housing main body 5*a*. The bottom portion 5*b* is formed in a circular-disk shape. Moreover, the bottom portion 5*b* is formed with a shaft-portion insertion hole 5*c* having a large diameter, at a substantially center of the bottom portion 5*b*. An after-mentioned eccentric shaft portion 39 is inserted through the shaft-portion insertion hole 5*c*. A hole edge of the shaft-portion insertion hole 5*c* is formed integrally with an extending portion (exiting portion) 5*d* which protrudes from the bottom portion 5*b* in the axial direction of the cam shaft 2 in a cylindrical-tube shape. Moreover, an outer circumferential portion of a front-end surface of the bottom portion 5*b* is formed integrally with the female-thread constituting portion 6.

The cam shaft 2 includes two drive cams per one cylinder of the engine. Each drive cam is provided on an outer circumference of the cam shaft 2, and functions to open an intake valve (not shown). The front end portion of the cam shaft 2 is formed integrally with a flange portion 2*a*.

As shown in FIG. 1, an outer diameter of the flange portion 2*a* is designed to be slightly larger than an outer diameter of an after-mentioned fixing end portion 9*a* of the follower member 9. An outer circumferential portion of a front end surface of the flange portion 2*a* is in contact with an axially outer end surface of the inner race 43*b* of the large-diameter ball bearing 43, after an assembly of respective structural components. Moreover, the front end surface of the flange portion 2*a* is fixedly connected with the follower member 9 from the axial direction by a cam bolt 10 under a state where the front end surface of the flange portion 2*a* is in contact with the follower member 9 in the axial direction.

As shown in FIG. 5, an outer circumference of the flange portion 2*a* is formed with a stopper concave groove 2*b* into which the stopper convex portion 61*b* of the retaining plate 61 is inserted and engaged. The stopper concave groove 2*b* is formed along a circumferential direction of the flange portion 2*a*. (A bottom surface of) The stopper concave groove 2*b* is formed in a circular-arc shape in cross section when taken by a plane perpendicular to the axial direction of the cam shaft 2. The stopper concave groove 2*b* is formed in an outer circumferential surface of the flange portion 2*a* within a predetermined range given in a circumferential direction of the cam shaft 2. The cam shaft 2 rotates within this circumferential range relative to the sprocket main body is so that one of both end edges of the stopper convex portion 61*b* becomes in contact with the corresponding one of circumferentially-opposed edges 2*c* and 2*d* of the stopper concave groove 2*b*. Thereby, a relative rotational position of the cam shaft 2 to the timing sprocket 1 is restricted between a maximum advanced side and a maximum retarded side.

The stopper convex portion 61*b* is disposed axially away toward the cam shaft 2 from a point at which the outer race 43*a* of the large-diameter ball bearing 43 is pressed by the spacer 62 for fixing the outer race 43*a* in the axial direction. Accordingly, the stopper convex portion 61*b* is not in contact with the fixing end portion 9*a* of the follower member 9. Therefore, an interference between the stopper convex portion 61*b* and the fixing end portion 9*a* can be sufficiently suppressed.

The stopper convex portion 61*b* and the stopper concave groove 2*b* constitute a stopper mechanism.

As shown in FIG. 1, the cam bolt 10 includes a head portion 10*a* and a shaft portion 10*b*. A washer portion 10*c* formed in an annular shape is provided on an end surface of the head portion 10*a* which is located on the side of the shaft portion 10*b*. An outer circumference of the shaft portion 10*b* includes a male thread portion 10*d* which is screwed into a female threaded portion of the cam shaft 2. The female threaded portion of the cam shaft 2 is formed from the end portion of the cam shaft 2 toward an inside of the cam shaft 2 in the axial direction.

The follower member 9 which functions as a driven rotating member is integrally formed of an iron-based metal. As shown in FIG. 1, the follower member 9 includes the fixing end portion 9*a*, a cylindrical portion (circular tube portion) 9*b* and a cylindrical retainer 41. The fixing end portion 9*a* is in a circular-plate shape and is formed in a rear end side of the follower member 9. The cylindrical portion 9*b* protrudes in the axial direction from a front end of an inner circumferential portion of the fixing end portion 9*a*. The retainer 41 is formed integrally with an outer circumferential portion of the fixing end portion 9*a*, and retains or guides a plurality of rollers 48.

A rear end surface of the fixing end portion 9*a* is in contact with the front end surface of the flange portion 2*a* of the cam shaft 2. The fixing end portion 9*a* is pressed and fixed to the flange portion 2*a* in the axial direction by an axial force of the cam bolt 10.

As shown in FIG. 1, the cylindrical portion 9*b* is formed with an insertion hole 9*d* passing through a center of the cylindrical portion 9*b* in the axial direction. The shaft portion 10*b* of the cam bolt 10 is passed through the insertion hole 9*d*. Moreover, a needle bearing 38 functions as a bearing member is provided on an outer circumferential side of the cylindrical portion 9*b*.

Figure 4:
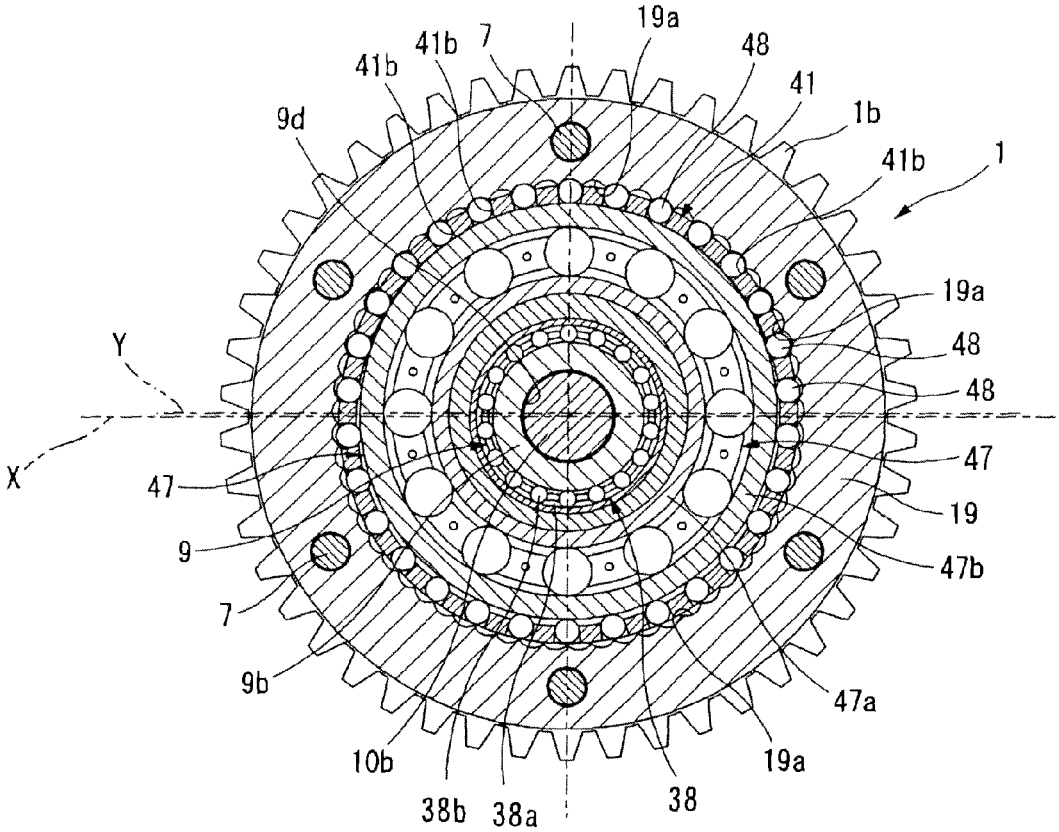
FIG. 4 is a sectional view of FIG. 1, taken along a line A-A.

As shown in FIGS. 1, 3 and 4, the retainer 41 is formed in a cylindrical shape (circular-tube shape) having its bottom and protruding from the bottom in the extending direction of the cylindrical portion 9*b*. The retainer 41 is bent in a substantially L-shape in cross section from a front end of the outer circumferential portion of the fixing end portion 9*a*. A tubular tip portion 41*a* of the retainer 41 extends and exits through a space portion 44 toward the bottom portion 5*b* of the housing 5. The space portion 44 is an annular concave portion formed between the female-thread constituting portion 6 and the extending portion 5*d*. Moreover, a plurality of roller-retaining holes 41*b* are formed in the tubular tip portion 41*a* substantially at circumferentially equally-spaced intervals. Each of the plurality of roller-retaining holes 41*b* is formed in a substantially rectangular shape in cross section, and functions as a roller retaining portion which retains the roller 48 to allow a rolling movement of the roller 48. The total number of the roller-retaining holes 41*b* (or the total number of the rollers 48) is smaller by one than the total number of the internal teeth 19*a* of the internal-teeth constituting portion 19.

An inner-race fixing portion 63 is formed in a cut-out manner between the outer circumferential portion of the fixing end portion 9*a* and a bottom-side connecting portion of the retainer 41. The inner-race fixing portion 63 fixes or fastens the inner race 43*b* of the large-diameter ball bearing 43.

The inner-race fixing portion 63 is formed by cutting the follower member 9 in a stepped manner (multilevel manner)

such that the inner-race fixing portion 63 faces the outer-race fixing portion 60 in the radial direction. The inner-race fixing portion 63 includes an outer circumferential surface 63*a* and a second fixing stepped surface (multilevel-linking surface) 63*b*. The outer circumferential surface 63*a* is in an annular shape (tubular shape) extending in the axial direction of the cam shaft 2. The second fixing stepped surface 63*b* is formed integrally with the outer circumferential surface 63*a* on a side opposite to an opening of the outer circumferential surface 63*a*, and extends in the radial direction. The inner race 43*b* of the large-diameter ball bearing 43 is fitted into the outer circumferential surface 63*a* in the axial direction by means of press fitting. Thereby, an inner end surface 43*f* of the press-fitted inner race 43*b* becomes in contact with the second fixing stepped surface 63*b*, so that an axial positioning of the inner race 43*b* is done.

The phase change mechanism 4 includes the electric motor 12 and the speed-reduction mechanism 8. The electric motor 12 is disposed on a front end side of the cam shaft 2, substantially coaxially to the cam shaft 2. The speed-reduction mechanism 8 functions to reduce a rotational speed of the electric motor 12 and to transmit the reduced rotational speed to the cam shaft 2.

As shown in FIGS. 1 and 3, the electric motor 12 is a brush DC motor. The electric motor 12 is constituted by the housing 5, a motor output shaft 13, a pair of permanent magnets 14 and 15, and a stator 16. The housing 5 is a yoke which rotates integrally with the timing sprocket 1. The motor output shaft 13 is arranged inside the housing 5 to be rotatable relative to the housing 5. The pair of permanent magnets 14 and 15 are fixed to an inner circumferential surface of the housing 5. Each of the pair of permanent magnets 14 and 15 is formed in a half-round arc shape. The stator 16 is fixed to the sealing plate 11.

The motor output shaft 13 is formed in a stepped tubular shape (in a cylindrical shape having multileveled surface), and functions as an armature. The motor output shaft 13 includes a large-diameter portion 13*a*, a small-diameter portion 13*b*, and a stepped portion (multilevel-linking portion) 13*c*. The stepped portion 13*c* is formed at a substantially axially center portion of the motor output shaft 13, and is a boundary between the large-diameter portion 13*a* and the small-diameter portion 13*b*. The large-diameter portion 13*a* is located on the side of the cam shaft 2 whereas the small-diameter portion 13*b* is located on the side of the brush retaining member 28. An iron-core rotor 17 is fixed to an outer circumference of the large-diameter portion 13*a*. The eccentric shaft portion 39 is fitted and fixed into the large-diameter portion 13*a* in the axial direction by means of press fitting, so that an axial positioning of the eccentric shaft portion 39 is done by an inner surface of the stepped portion 13*c*.

On the other hand, an annular member (tubular member) 20 is fitted over and fixed to an outer circumference of the small-diameter portion 13*b* by press fitting. A commutator 21 is fitted over and fixed to an outer circumferential surface of the annular member 20 by means of press fitting in the axial direction. Hence, an outer surface of the stepped portion 13*c* performs an axial positioning of the annular member 20 and the commutator 21. An outer diameter of the annular member 20 is substantially equal to an outer diameter of the large-diameter portion 13*a*. An axial length of the annular member 20 is slightly shorter than an axial length of the small-diameter portion 13*b*.

The axial positioning (i.e., location setting) for both of the eccentric shaft portion 39 and the commutator 21 is performed by the inner and outer surfaces of the stepped portion 13*c*. Accordingly, an assembling work is easy while an accuracy of the positioning is improved.

A front edge of the small-diameter portion 13*b* faces an inner surface 3*f* of the cover main body 3*a* of the cover member 3. A space S1 having a predetermined width is formed between the front edge of the small-diameter portion 13*b* and the inner surface 3*f* of the cover main body 3*a*.

Lubricating oil is supplied to an inside space of the motor output shaft 13 and the eccentric shaft portion 39 in order to lubricate the bearings 37 and 38. A plug member (plug) 55 is fixedly fitted into an inner circumferential surface of the small-diameter portion 13*b* by press fitting. The plug member 55 inhibits the lubricating oil from leaking to the external.

As shown in FIGS. 1 and 2, the plug member 55 is formed in a substantially U-shape in cross section. The plug member 55 includes a core member 56 and an elastic body 57. The core member 56 is made of metal. The elastic body 57 coats (is molded to) an entire surface of the core member 56, i.e. coats an entire exterior of the core member 56.

The core member 56 includes a disk-like main body 56*a*, and an outer circumferential portion 56*b* formed integrally with an outer circumferential edge of the main body 56*a*. The core member 56 is formed in a flange shape by bending the outer circumferential portion 56*b* toward the ball bearing 37 in a manner of L-shape in cross section. Whole of the core member 56 is substantially in the form of "[" (square bracket) or "U" in cross section. Moreover, the disk-like main body 56*a* is formed with a circular through-hole 56*c* having a relatively large diameter. The circular through-hole 56*c* passes through a substantially center portion of the disk-like main body 56*a*. That is, whole of the core member 56 is formed in a bottomed tubular shape (bottomed cylindrical shape) having the circular through-hole 56*c* in the bottom of the core member 56.

On the other hand, the elastic body 57 is made of a flexible or pliant material such as a synthetic rubber. The elastic body 57 is integrally attached and fixed to whole of inner and outer circumferential surfaces of the main body 56*a* and also whole of inner and outer circumferential surfaces of the outer circumferential portion 56*b*, by means of vulcanization adhesion. A circular wall portion 57*a* of the elastic body 57 which is located at a center of the elastic body 57 closes (fills) the circular through-hole 56*c* of the disk-like main body 56*a*. An outer diameter of an outer circumferential portion 57*b* of the elastic body 57 is formed to be slightly larger than an inner diameter of the small-diameter portion 13*b* of the motor output shaft 13. Thereby, a margin of the plug member 55 which causes the press-fitting against the inner circumferential surface of the small-diameter portion 13*b* is secured. Hence, the plug member 55 is elastically in contact with the inner circumferential surface of the small-diameter portion 13*b* so that the plug member 55 liquid-tightly seals between the axial inside and outside of the motor output shaft 13.

The iron-core rotor 17 is formed of magnetic material having a plurality of magnetic poles. An outer circumferential side of the iron-core rotor 17 constitutes bobbins each having a slot. (A coil wire of) An electromagnetic coil 18 is wound on the bobbin.

The commutator 21 is made of electrical conductive material and is formed in an annular shape. The commutator 21 is divided into segments. The number of the segments is equal to the number of poles of the iron-core rotor 17. Each of the segments of the commutator 21 is electrically connected to a terminal of the coil wire (not shown) of the electromagnetic coil 18. That is, a tip of the terminal of the coil wire is sandwiched by a turn-back portion of the commutator 21 which is formed on an inner circumferential side of the electromagnetic coil 18, so that the commutator 21 is electrically connected to the electromagnetic coils 18.

The permanent magnets 14 and 15 are formed in a cylindrical shape (circular-tube shape), as a whole. The permanent magnets 14 and 15 have a plurality of magnetic poles along a circumferential direction thereof. An axial location of the permanent magnets 14 and 15 is deviated (offset) in the frontward direction from an axial location of the iron-core rotor 17. That is, with respect to the axial direction, a center of the permanent magnet 14 or 15 is located at a frontward site beyond a center of the iron-core rotor 17 by a predetermined distance, as shown in FIG. 1. In other words, the stator 16 is closer to the center of the permanent magnet 14 or 15 than to the center of the iron-core rotor 17 by the predetermined distance, with respect to the axial direction.

Thereby, a front end portion of the permanent magnet 14, 15 overlaps with the commutator 21 and also an after-mentioned first brush 25*a*, 25*b* of the stator 16 and so on, in the radial direction.

Figure 6:
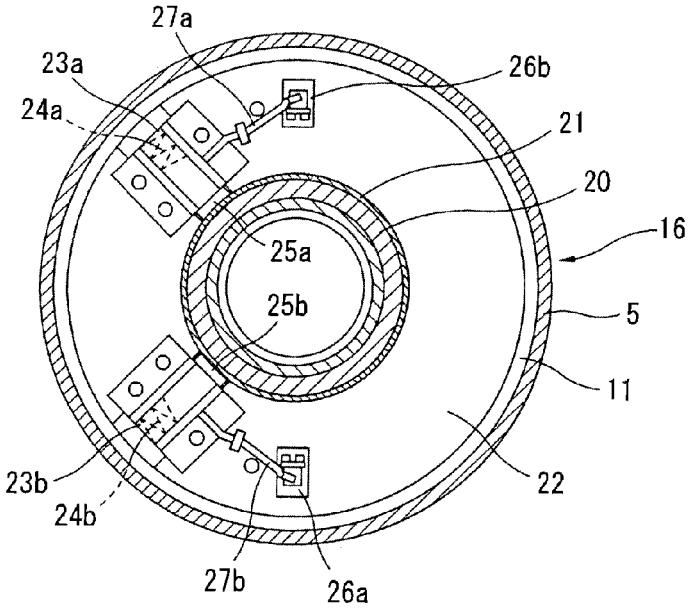
FIG. 6 is a sectional view of FIG. 1, taken along a line C-C.

As shown in FIG. 6, the stator 16 mainly includes a resin plate 22, a pair of resin holders 23*a* and 23*b*, a pair of first brushes 25*a* and 25*b* each functioning as a switching brush (commutator), inner and outer slip rings 26*a* and 26*b*, and pigtail harnesses 27*a* and 27*b*. The resin plate 22 is formed in a circular plate shape, and is formed integrally with an inner circumferential portion of the sealing plate 11. The pair of resin holders 23*a* and 23*b* are provided on an inside portion (cam-shaft-side portion) of the resin plate 22. The pair of first brushes 25*a* and 25*b* are received or accommodated respectively in the pair of resin holders 23*a* and 23*b* such that the first brushes 25*a* and 25*b* are able to slide in contact with the resin holders 23*a* and 23*b* in the radial direction. Thereby, a tip surface of each of the first brushes 25*a* and 25*b* is elastically in contact with an outer circumferential surface of the commutator 21 in the radial direction by a spring force of coil spring 24*a*, 24*b*. Each of the inner and outer slip rings 26*a* and 26*b* is formed in an annular shape. The inner and outer slip rings 26*a* and 26*b* are buried in and fixed to front end surfaces of the resin holders 23*a* and 23*b* under a state where outer end surfaces (front end surfaces) of the slip rings 26*a* and 26*b* are exposed to the space S1. As shown in FIG. 1, the inner and outer slip rings 26*a* and 26*b* are disposed at an identical axial location and are disposed at radially inner and outer locations in a manner of radially-double layout. The pigtail harness 27*a* electrically connects the first brush 25*a* with the slip ring 26*b* whereas the pigtail harness 27*b* electrically connects the first brush 25*b* with the slip ring 26*a*. It is noted that the slip rings 26*a* and 26*b* constitute a part of a power-feeding mechanism according to the present invention. Moreover, the first brushes 25*a* and 25*b*, the commutator 21, the pigtail harnesses 27*a* and 27*b* and the like constitute an energization switching section (switching means) according to the present invention.

A positioning of the sealing plate 11 is given by a concave stepped portion formed in an inner circumference of the front end portion of the housing 5. The sealing plate 11 is fixed into the concave stepped portion of the housing 5 by caulking. A shaft insertion hole 11*a* is formed in the sealing plate 11 to pass through a center portion of the sealing plate 11 in the axial direction. One end portion of the motor output shaft 13 and so on are passing through the shaft insertion hole 11*a*.

The brush retaining member 28 is fixed to the cover main body 3*a*. The brush retaining member 28 is integrally molded by synthetic resin material, and constitutes the power-feeding mechanism. As shown in FIG. 1, the brush retaining member 28 is substantially formed in an L-shape as viewed laterally, i.e., in cross section taken by a plane parallel to the axial direction and parallel to an extending direction of an after-mentioned terminal strip 31. The brush retaining member 28 mainly includes a brush retaining portion 28*a*, a connector portion 28*b*, a pair of bracket portions 28*c* and 28*c*, and a pair of terminal strips 31 and 31. The brush retaining portion 28*a* is substantially in a cylindrical shape, and is inserted in the retaining hole 3*d*. The connector portion 28*b* is located on an upper end portion of the brush retaining portion 28*a*. The pair of bracket portions 28*c* and 28*c* are formed integrally with the brush retaining portion 28*a*, and protrude from both sides of the brush retaining portion 28*a* in both directions perpendicular to the axial direction and perpendicular to the extending direction of the terminal strip 31. Through the pair of bracket portions 28*c* and 28*c*, the brush retaining member 28 is fixed to the cover main body 3*a*. A major part of the pair of terminal strips 31 and 31 is buried in the connector portion 28*b*.

The pair of terminal strips 31 and 31 extend in the upper-lower direction, and extend parallel to each other. The pair of terminal strips 31 and 31 are formed in a crank shape. One end (lower end) 31*a* of each of the terminal strips 31 and 31 is exposed at a bottom portion of the brush retaining portion 28*a* whereas another end (upper end) 31*b* of each of the terminal strips 31 and 31 is introduced in a female fitting groove 28*d* of the connector portion 28*b* and protrudes from a bottom of the female fitting groove 28*d*, as shown in FIG. 1. Moreover, the another ends 31*b* and 31*b* of the terminal strips 31 and 31 are electrically connected through a male connector (not shown) to a battery power source.

The brush retaining portion 28*a* is provided to extend in a substantially horizontal direction (i.e., in the axial direction). The brush retaining portion 28*a* is formed with through-holes each having a cylindrical-column shape, at upper and lower portions of an inside of the brush retaining portion 28*a*. Sliding members 29*a* and 29*b* each having a sleeve shape are provided respectively in the upper and lower through-holes of the brush retaining portion 28*a*, and are respectively fixed to the upper and lower through-holes of the brush retaining portion 28*a*. Second brushes 30*a* and 30*b* are received and retained respectively in the sliding members 29*a* and 29*b* to allow the second brushes 30*a* and 30*b* to slide in contact with the sliding members 29*a* and 29*b* in the axial direction. A tip surface of each of the second brushes 30*a* and 30*b* is in contact with the slip ring 26*a*, 26*b* in the axial direction.

Each of the second brushes 30*a* and 30*b* is formed in a substantially rectangular-parallelepiped shape. Each of second coil springs 32*a* and 32*b* is elastically disposed between the second brush 30*a*, 30*b* and the one end 31*a* of the terminal strip 31 which is exposed to a bottom portion of the through-hole of the brush retaining portion 28*a*. The second brushes 30*a* and 30*b* are biased respectively toward the slip rings 26*b* and 26*a* by spring forces of the second coil springs 32*a* and 32*b*. The large-diameter oil seal 50 prevents lubricating oil from entering a gap between the slip ring 26*a*, 26*b* and the second brush 30*a*, 30*b*.

A pigtail harness 33*a* having a flexibility is disposed between a front end portion (a hole-bottom-side end portion) of the second brush 30*a* and one of the one ends 31*a* and 31*a* of the terminal strips 31 and 31, and is attached to the front end portion of the second brush 30*a* and the one of the one ends 31*a* and 31*a* by welding. In the same manner, a pigtail harness 33*b* having a flexibility is disposed between a front end portion of the second brush 30*b* and another of the one ends 31*a* and 31*a* of the terminal strips 31 and 31, and is attached to the front end portion of the second brush 30*b* and the another of the one ends 31*a* and 31*a* by welding. Thereby, the second brushes 30*a* and 30*b* are electrically connected to the terminal strips 31 and 31. A length of each of the pigtail harnesses 33*a* and 33*b* is designed to restrict a maximum sliding position of the second brush 30*a*, 30*b* such that the second brush 30*a*, 30*b* is prevented from dropping out from the sliding member 29*a*, 29*b* when the second brush 30*a*, 30*b* has moved and slid in an axially-outward direction at the maximum by the second coil spring 32*a*, 32*b*.

Moreover, an annular (ring-shaped) seal member 34 is fitted into and held by an annular fitting groove which is formed on an outer circumference of a base portion side of the brush retaining portion 28*a*. The annular seal member 34 becomes elastically in contact with a tip surface of the cylindrical wall 3*c* to seal an inside of the brush retaining portion 28*a* when the brush retaining portion 28*a* is inserted into the retaining hole 3*d*.

The male connector (not shown) is inserted into the female fitting groove 28*d* which is located at an upper end portion of the connector portion 28*b*. The another ends 31*b* and 31*b* which are exposed to the female fitting groove 28*d* of the connector portion 28*b* are electrically connected through the male connector to a control unit (not shown).

As shown in FIG. 3, each of the bracket portions 28*c* and 28*c* is formed in a substantially triangular shape and is formed with a bolt insertion hole 28*e*. Theses bolt insertion holes 28*e* and 28*e* located at both sides of the brush retaining portion 28*a* axially pass through the bracket portions 28*c* and 28*c*. A pair of bolts are respectively inserted through the bolt insertion holes 28*e* and 28*e*, and are screwed into a pair of female threaded holes (not shown) formed in the cover main body 3*a*. Thereby, the brush retaining member 28 is fixed to the cover main body 3*a* through the bracket portions 28*c* and 28*c*.

The motor output shaft 13 and the eccentric shaft portion 39 are rotatably supported by the small-diameter ball bearing 37 and the needle bearing 38. The small-diameter ball bearing 37 is a bearing member provided on an outer circumferential surface of a head-portion-side portion of the shaft portion 10*b* of the cam bolt 10. The needle bearing 38 is provided on an outer circumferential surface of the cylindrical portion 9*b* of the follower member 9, and is located axially adjacent to the small-diameter ball bearing 37.

The needle bearing 38 includes a cylindrical retainer 38*a* and a plurality of needle rollers 38*b*. The retainer 38*a* is formed in a cylindrical shape (circular-tube shape), and is fitted in an inner circumferential surface of the eccentric shaft portion 39 by press fitting. Each needle roller 38*b* is a rolling element supported rotatably inside the retainer 38*a*. The needle rollers 38*b* roll on the outer circumferential surface of the cylindrical portion 9*b* of the follower member 9.

An inner race of the small-diameter ball bearing 37 is fixed between a front end edge of the cylindrical portion 9*b* of the follower member 9 and a washer 10*c* of the cam bolt 10 in a sandwiched state. On the other hand, an outer race of the small-diameter ball bearing 37 is fixedly fitted in a stepped diameter-enlarged portion of the inner circumferential surface of the eccentric shaft portion 39 by press fitting. The outer race of the small-diameter ball bearing 37 is axially positioned by contacting a step edge (barrier) formed in the stepped diameter-enlarged portion of the inner circumferential surface of the eccentric shaft portion 39.

A small-diameter oil seal 46 is provided between the outer circumferential surface of the motor output shaft 13 (eccentric shaft portion 39) and an inner circumferential surface of the extending portion 5*d* of the housing 5. The oil seal 46 prevents lubricating oil from leaking from an inside of the speed-reduction mechanism 8 into the electric motor 12. The oil seal 46 separates the electric motor 12 from the speed-reduction mechanism 8 by a searing function of the oil seal 46.

The control unit detects a current operating state of the engine on the basis of information signals derived from various kinds of sensors and the like, such as a crank angle sensor, an air flow meter, a water temperature sensor and an accelerator opening sensor (not shown). Thereby, the control unit controls the engine. Moreover, the control unit performs a rotational control for the motor output shaft 13 by supplying electric power to the electromagnetic coils 18. Thereby, the control unit controls a relative rotational phase of the cam shaft 2 to the timing sprocket 1, through the speed-reduction mechanism 8.

As shown in FIGS. 1 and 3, the speed-reduction mechanism 8 is mainly constituted by the eccentric shaft portion 39, a medium-diameter ball bearing 47, the rollers 48, the retainer 41, and the follower member 9 formed integrally with the retainer 41. The eccentric shaft portion 39 conducts an eccentric rotational motion. The medium-diameter ball bearing 47 is provided on an outer circumference of the eccentric shaft portion 39. The rollers 48 are provided on an outer circumference of the medium-diameter ball bearing 47. The retainer 41 retains (guides) the rollers 48 along a rolling direction of the rollers 48, and permits a radial movement of each roller 48.

The eccentric shaft portion 39 is formed in a stepped cylindrical shape (stepped circular-tube shape) having a multilevel diameter. A small-diameter portion 39*a* of the eccentric shaft portion 39 which is located in a front end side of the eccentric shaft portion 39 is fixedly fitted in an inner circumferential surface of the large-diameter portion 13*a* of the motor output shaft 13 by press fitting. As shown in FIG. 4, an outer circumferential surface of a large-diameter portion 39*b* of the eccentric shaft portion 39 which is located in a rear end side of the eccentric shaft portion 39, i.e. a cam surface of the eccentric shaft portion 39 has a center (axis) Y which is eccentric (deviated) slightly from a shaft center X of the motor output shaft 13 in the radial direction.

Substantially whole of the medium-diameter ball bearing 47 overlaps with the needle bearing 38 in the radial direction, i.e., the medium-diameter ball bearing 47 is located approximately within an axial existence range of the needle bearing 38. The medium-diameter ball bearing 47 includes an inner race 47*a*, an outer race 47*b*, and a ball(s) 47*c* interposed between both the races 47*a* and 47*b*. The inner race 47*a* is fixed to the outer circumferential surface of the eccentric shaft portion 39 by press fitting. The outer race 47*b* is not fixed in the axial direction, and thereby is in an axially freely-movable state. That is, one of axial end surfaces of the outer race 47*b* which is closer to the electric motor 12 is not in contact with any member whereas another of the axial end surfaces of the outer race 47*b* faces an inside surface of the retainer 41 to have a first clearance (minute clearance) C between the another of the axial end surfaces of the outer race 47*b* and the inside surface of the retainer 41. Moreover, an outer circumferential surface of the outer race 47*b* is in contact with an outer circumferential surface of each of the rollers 48 so as to allow the rolling motion of each roller 48. An annular second clearance C1 is formed on the outer circumferential surface of the outer race 47*b*. By virtue of the second clearance C1, whole of the medium-diameter ball bearing 47 can move in the radial direction in response to an eccentric rotation (of the outer circumferential surface of the large-diameter portion 39*b*) of the eccentric shaft portion 39, i.e., can perform an eccentric movement.

Each of the rollers 48 is formed of iron-based metal. With the eccentric movement of the medium-diameter ball bearing 47, the respective rollers 48 move in the radial direction and are fitted in the internal teeth 19*a* of the internal-teeth constituting portion 19. Also, with the eccentric movement of the medium-diameter ball bearing 47, the rollers 48 are forced to do a swinging motion in the radial direction while being guided in the circumferential direction by both side edges of the roller-retaining holes 41*b* of the retainer 41. That is, the rollers 48 are moved closer to the internal teeth 19*a* and are moved away from the internal teeth 19*a*, repeatedly, by the eccentric movement of the medium-diameter ball bearing 47.

Lubricating oil is supplied into the speed-reduction mechanism 8 by a lubricating-oil supplying means (supplying section). This lubricating-oil supplying means includes an oil supply passage, an oil supply hole 51, an oil hole 52 having a small hole diameter, and three oil discharge holes (not shown) each having a large hole diameter. The oil supply passage is formed inside the bearing of the cylinder head. Lubricating oil is supplied from a main oil gallery (not shown) to the oil supply passage. The oil supply hole 51 is formed inside the cam shaft 2 to extend in the axial direction as shown in FIG. 1. The oil supply hole 51 communicates though a groove(s) with the oil supply passage. The oil hole 52 is formed inside the follower member 9 to pass through the follower member 9 in the axial direction. One end of the oil hole 52 is open to the oil supply hole 51, and another end of the oil hole 52 is open to a region near the needle bearing 38 and the medium-diameter ball bearing 47. The three oil discharge holes are formed inside the follower member 9 to pass through the follower member 9 in the same manner.

By the lubricating-oil supplying means, lubricating oil is supplied to the space portion 44 and held in the space portion 44. Thereby, the lubricating oil lubricates the medium-diameter ball bearing 47 and the rollers 48. Moreover, the lubricating oil flows to the inside of the eccentric shaft portion 39 and the inside of the motor output shaft 13 so that moving elements such as the needle bearing 38 and the small-diameter ball bearing 37 are lubricated. It is noted that the small-diameter oil seal 46 inhibits the lubricating oil held in the space portion 44 from leaking to the inside of the housing 5.

Next, operations in this embodiment according to the present invention will now be explained. At first, when the crankshaft of the engine is drivingly rotated, the timing sprocket 1 is rotated through the timing chain 42. This rotative force is transmitted through the internal-teeth constituting portion 19 and the female-thread constituting portion 6 to the housing 5. Thereby, the electric motor 12 rotates in synchronization. On the other hand, the rotative force of the internal-teeth constituting portion 19 is transmitted through the rollers 48, the retainer 41 and the follower member 9 to the cam shaft 2. Thereby, the cam of the cam shaft 2 opens and closes the intake valve.

Under a predetermined engine-operating state after the start of the engine, the control unit supplies electric power to the electromagnetic coils 17 of the electric motor 12 through the terminal strips 31 and 31, the pigtail harnesses 33*a* and 33*b*, the second brushes 30*a* and 30*b* and the slip rings 26*b* and 26*a* and the like. Thereby, the rotation of the motor output shaft 13 is driven. This rotative force of the motor output shaft 13 is transmitted through the speed-reduction mechanism 8 to the cam shaft 2 so that a reduced rotation is transmitted to the cam shaft 2.

That is, (the outer circumferential surface of) the eccentric shaft portion 39 eccentrically rotates in accordance with the rotation of the motor output shaft 13. Thereby, each roller 48 rides over (is disengaged from) one internal tooth 19*a* of the internal-teeth constituting portion 19 and moves to the other adjacent internal tooth 19*a* with its rolling motion while being radially guided by the roller-retaining holes 41*b* of the retainer 41, every one rotation of the motor output shaft 13. By repeating this motion sequentially, each roller 48 rolls in the circumferential direction under a contact state. By this contact rolling motion of each roller 48, the rotative force is transmitted to the follower member 9 while the rotational speed of the motor output shaft 13 is reduced. A speed reduction rate which is obtained at this time can be set at any value by adjusting the number of rollers 48 and the like.

Accordingly, the cam shaft 2 rotates in the forward or reverse direction relative to the timing sprocket 1 so that the relative rotational phase between the cam shaft 2 and the timing sprocket 1 is changed. Thereby, opening and closing timings of the intake valve are controllably changed to its advance or retard side.

As shown in FIG. 5, a maximum positional restriction (angular position limitation) for the forward/reverse relative rotation of cam shaft 2 to the timing sprocket 1 is performed when one of respective lateral surfaces (circumferentially-opposed surfaces) of the stopper convex portion 61*d* becomes in contact with the corresponding one of the circumferentially-opposed surfaces 2*c* and 2*d* of the stopper concave groove 2*b*.

Specifically, when the follower member 9 rotates (at a higher speed) in the same rotational direction as that of the timing sprocket 1 with the eccentric rotational motion of the eccentric shaft portion 39, one lateral surface of the stopper convex portion 61*d* becomes in contact with the surface 2*c* of the stopper concave groove 2*b* so that a further relative rotation of the follower member 9 in the same direction is prohibited. Thereby, the relative rotational phase of the cam shaft 2 to the timing sprocket 1 is changed to the advance side at maximum.

On the other hand, when the follower member 9 rotates in a relatively opposite rotational direction to that of the timing sprocket 1 (i.e., at a lower speed than the timing sprocket 1), another lateral surface of the stopper convex portion 61*d* becomes in contact with the surface 2*d* of the stopper concave groove 2*b* so that a further rotation of the follower member 9 in the relatively-opposite direction is prohibited. Thereby, the relative rotational phase of the cam shaft 2 to the timing sprocket 1 is changed to the retard side at maximum.

As a result, the opening and closing timings of the intake valve can be changed to the advance side or the retard side up to its maximum. Therefore, a fuel economy and an output performance of the engine are improved.

In this embodiment, the plug member 55 is fitted into and fixed to the inner circumferential surface of the small-diameter portion 13*b* of the motor output shaft 13 by press fitting. By means of liquid-tight sealing of the plug member 55, lubricating oil supplied from the small-diameter oil hole 52 of the lubricating-oil supplying means to the inside of the eccentric shaft portion 39 in order to lubricate the respective bearings 38 and 37 and the like is prohibited from leaking from a front end side of the motor output shaft 13 toward the external.

The plug member 55 is constructed by coating the entire surface (entire appearance) of the core member 56 with the elastic body 57. Hence, a sealing performance is enhanced by the elastic force of the elastic body 57. Since the outer circumferential portion 57*b* of the elastic body 57 applies a large press-contact force to the inner circumferential surface of the small-diameter portion 13*b*, an easy movement of the plug member 55 by oil pressure can be suppressed.

Moreover, in a case that the plug member 55 is desired to be detached from the inside of the small-diameter portion 13*b* of the motor output shaft 13 for the purpose of maintenance of the small-diameter ball bearing 37 or the like after the plug member 55 was fixed to the inner circumferential surface of the small-diameter portion 13*b* by press fitting, the plug member 55 can be easily detached from the inside of the motor output shaft 13 in the following manner. That is, for example, a jig or tool (not shown) having a tip portion formed in a hook shape is used to push and break the wall portion 57*a* which is a center portion of the elastic body 57, from the outside of the plug member 55 (i.e., from the outside of the small-diameter portion 13*b*). Then, a portion of the core member 56 located near a hole edge of the through-hole 56*c* is made to be hooked or caught on the hook-shaped tip portion of the jig at the inside of the small-diameter portion 13*b*. Then, by pulling (drawing) the hooked core member 56 toward the outside of the small-diameter portion 13*b*, the plug member 55 is easily detached from the motor output shaft 13. Therefore, a follow-up maintenance is easy.

Second Embodiment

Figure 7:
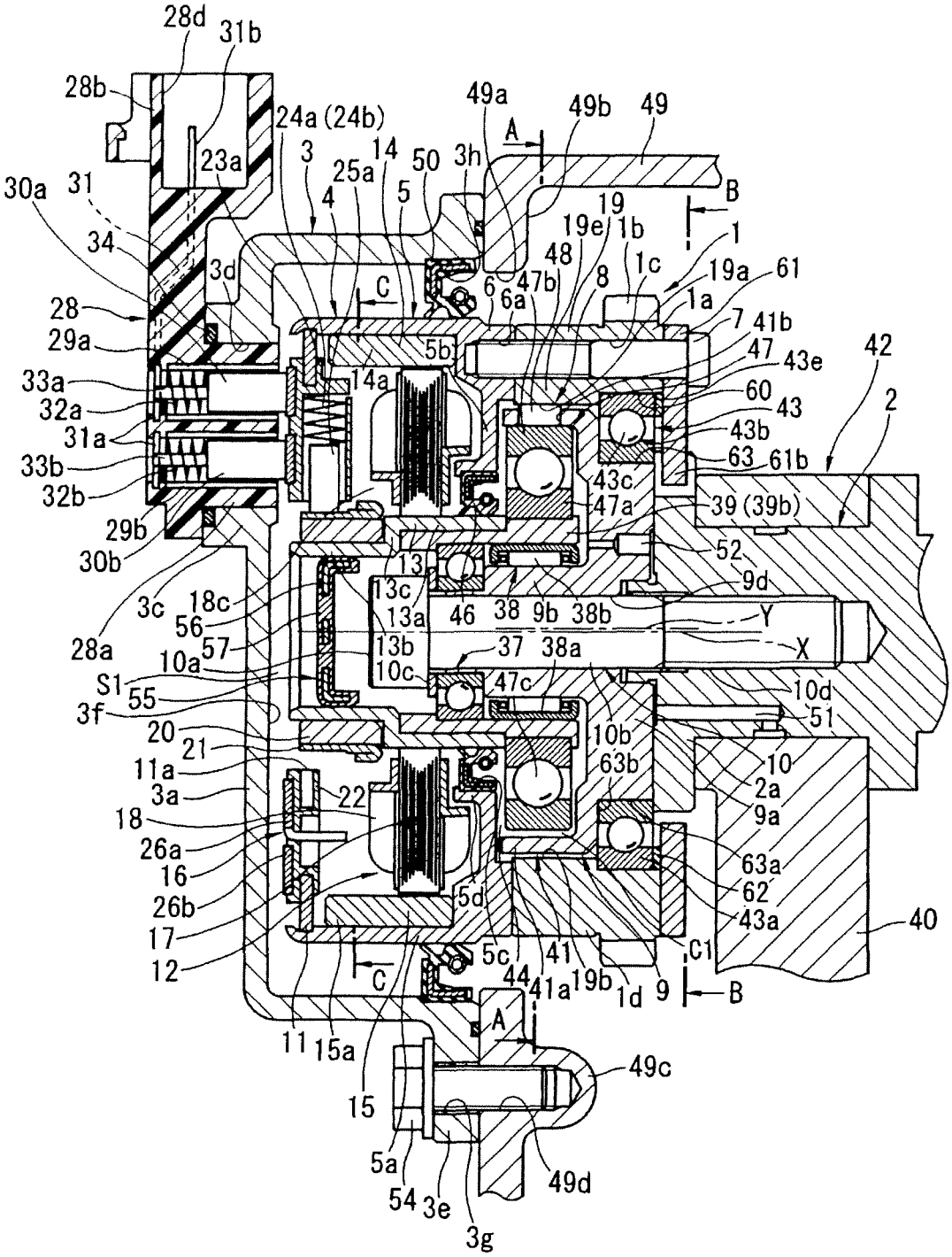
FIG. 7 is a longitudinal sectional view of a valve-timing control apparatus in a second embodiment according to the present invention.
Figure 8:
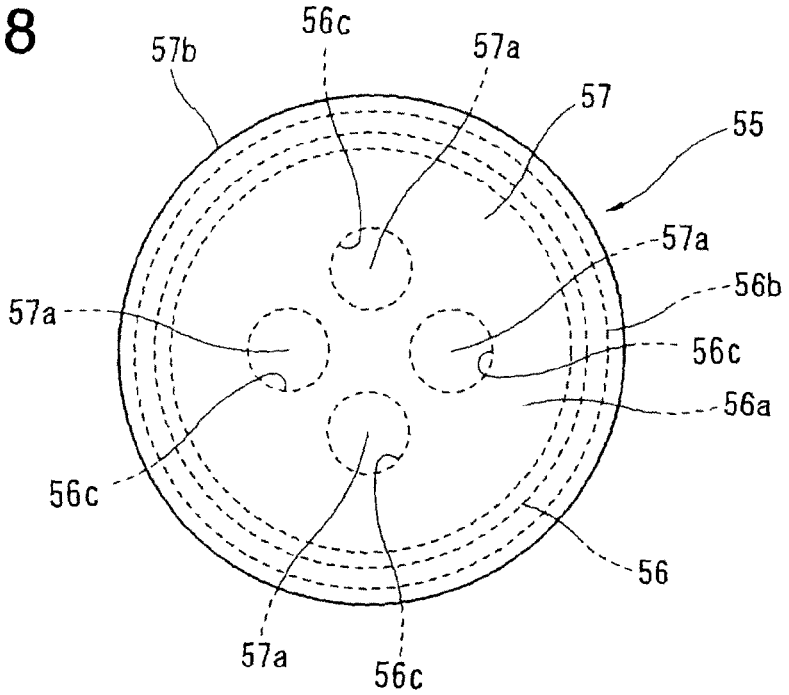
FIG. 8 is a front view of a plug member in the second embodiment.

FIG. 7 is a view showing a second embodiment according to the present invention. In the second embodiment, a structure of the core member 56 of the plug member 55 is changed in some degree. The main body 56*a* of the core member 56 in the second embodiment is formed with four circular through-holes 56*c* each having a relatively small diameter, also as shown in FIG. 8. The respective through-holes 56*c* are formed at circumferentially equally-spaced intervals in the main body 56*a*. Specifically, the four through-holes 56*c* are located substantially at 90-degree intervals in the circumferential direction of the main body 56*a*. An inner diameter of each of the four through-holes 56*c* is set at a size that enables to insert the hook-shaped tip portion of the jig through the through-hole 56*c*.

The elastic body 57 is integrally formed to coat or enclose the entire surface of the core member 56 by means of vulcanization adhesion, in the similar manner as in the first embodiment. At this time, four wall portions 57*a* of the elastic body 57 respectively close (fill) the four through-holes 56*c*. That is, each of the four wall portions 57*a* is in a circular shape having a small diameter which is substantially equal to the diameter of the through-hole 56*c*.

Since the other structures are similar to those of the first embodiment, the same operations and advantageous effects as the first embodiment are obtained. In particular, at the time of maintenance, the plug member 55 can be easily detached from the inside of the motor output shaft 13 by breaking one of the four wall portions 57*a* by use of the hook-shaped tip portion of the jig, by hooking an inside portion of the main body 56*a* located near the hole edge of the through-hole 56*c*, and then by pulling out the main body 56*a*.

In the second embodiment, the four through-holes 56*c* are provided. Accordingly, a target for the breaking by the tip portion of the jig can be selected from the four wall portions 57*a* positioned at different locations. Hence, a disinstallation (detaching operation) of the plug member 55 is made easier.

Moreover, in the second embodiment, the plurality of through-holes 56*c* are dotted (scattered) in the main body 56*a* of the core member 56. Accordingly, a central-portion side of the main body 56*a* has a high rigidity, so that the press-contact force that is applied by the elastic body 57 against the inner circumferential surface of the small-diameter portion 13*b* can be set at a large level.

Figure 9:
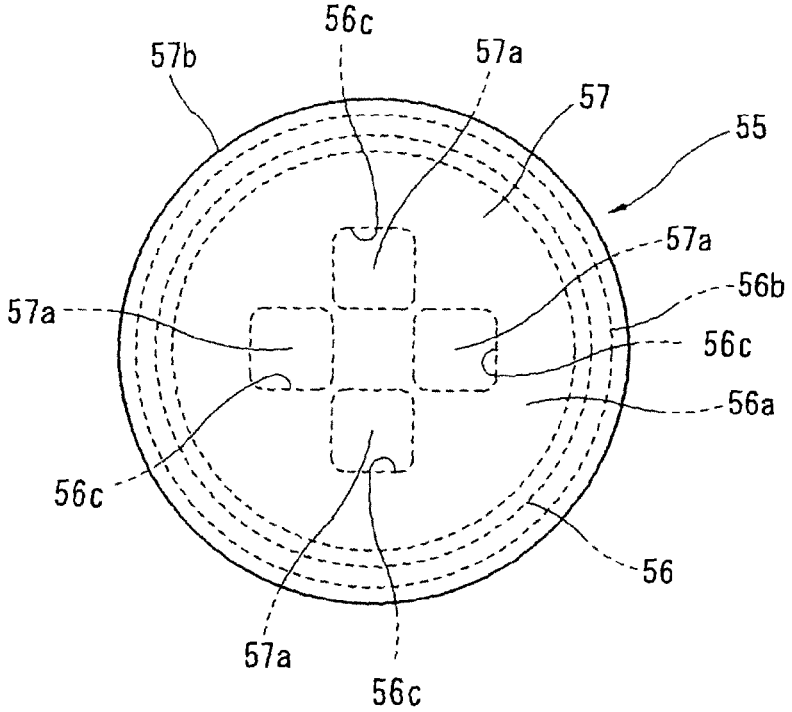
FIG. 9 is a front view of a plug member in another example of the second embodiment.

FIG. 9 is a view showing a modified example in the second embodiment. In this example, each of the four through-holes 56*c* of the core member 56 is formed in a different shape. That is, the shape of each of the four through-holes 56*c* is changed from the circular shape to a square shape, as viewed from the axial direction. Also, each of the four wall portions 57*a* corresponding to the four through-holes 56*c* is formed in a square shape.

Third Embodiment

Figure 10:
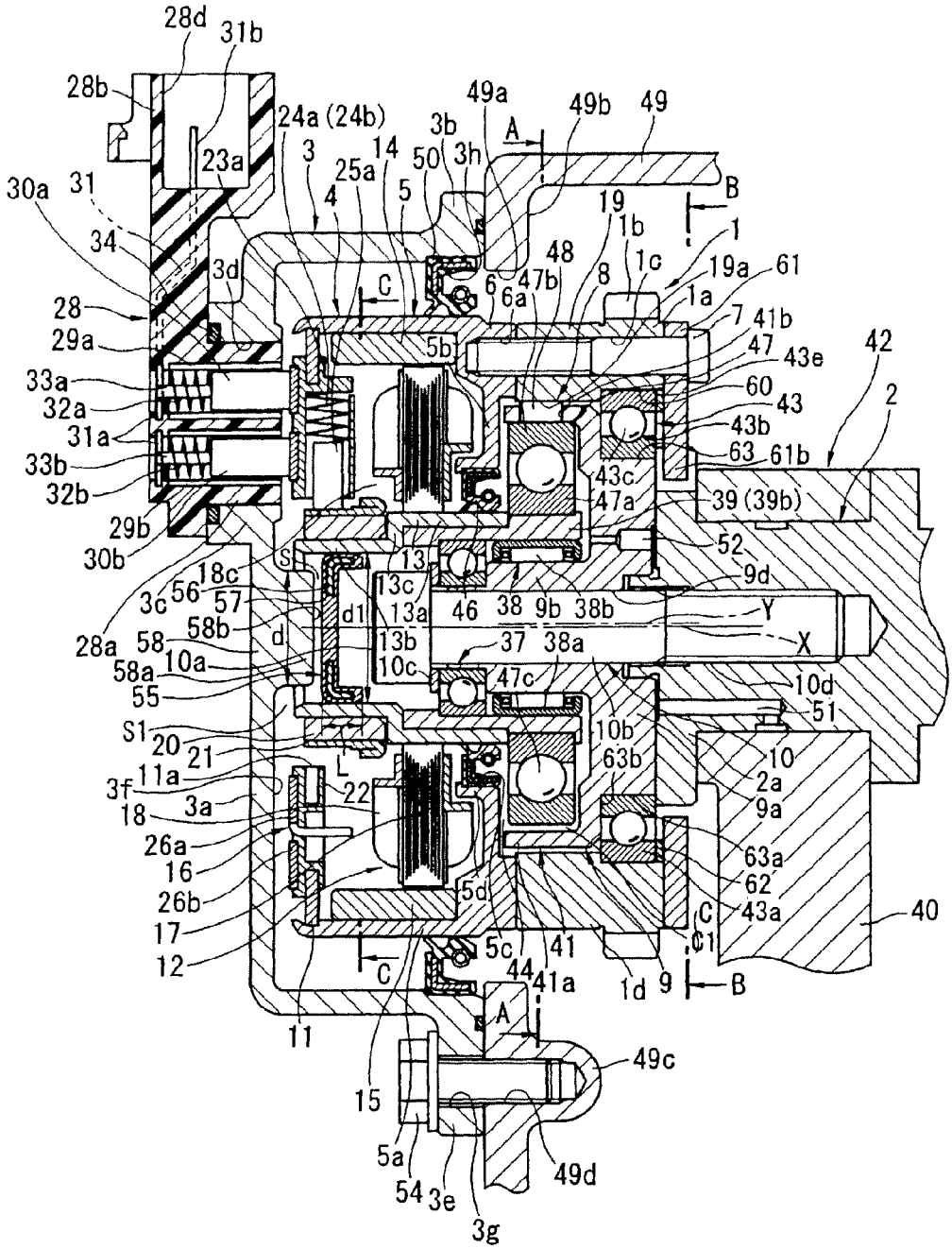
FIG. 10 is a longitudinal sectional view of a valve-timing control apparatus in a third embodiment according to the present invention.

FIG. 10 is a view showing a third embodiment according to the present invention. In the third embodiment, on the assumption that the structures of the first embodiment are basically adopted, a protruding portion 58 is integrally formed with the cover main body 3*a* at a substantially central portion of the inner surface of the cover main body 3*a*. The protruding portion 58 protruding toward the plug member 55 is formed in a cylindrical-column shape, and is located substantially coaxially to the motor output shaft 13. That is, an axis of the protruding portion 58 is substantially identical with an axis of the motor output shaft 13. Moreover, an outer diameter d of the protruding portion 58 is formed at a substantially constant size over whole the protruding portion 58. The outer diameter d is smaller than the inner diameter of the small-diameter portion 13*b* of the motor output shaft 13, and is greater than the diameter of the through-hole 56*c* of the core member 56. The protruding portion 58 includes a tip portion 58*a* having a tip surface 58*b* formed in a flat shape. The tip portion 58*a* is located radially inside the front end portion of the tubular motor output shaft 13. In other words, the tip portion 58*a* of the protruding portion 58 overlaps with the motor output shaft 13 in the radial direction, as shown in FIG. 10.

According the third embodiment, even if the plug member 55 has moved in the frontward direction by an oil pressure (hydraulic pressure) of lubricating oil supplied to the inside space of the tubular motor output shaft 13 or the like, the tip surface 58*b* of the protruding portion 58 becomes in contact with a front end surface of the plug member 55 so as to prevent a further frontward movement of the plug member 55. Therefore, the plug member 55 can be inhibited from dropping out from a front end of the motor output shaft 13.

In particular, the tip portion 58*a* of the protruding portion 58 extends up to a radially-inside location of the front end portion of the small-diameter portion 13*b* of the motor output shaft 13. Accordingly, the space S1 between the front edge of the small-diameter portion 13*b* of the motor output shaft 13 and the inner surface 3*f* of the cover main body 3*a* can be set as a relatively large space. Therefore, a contact between the cover member 3 and the motor output shaft 13 can be avoided even if an oscillating motion (vibrations) or the like occurs.

Although the invention has been described above with reference to certain embodiments of the invention, the invention is not limited to the embodiments described above. Modifications and variations of the embodiments described above will occur to those skilled in the art in light of the above teachings.

For example, the shape and/or size of the through-hole 56*c* of the core member 56 can be changed to any desired shape and/or size.

Configurations

Some technical configurations obtainable from the above embodiments according to the present invention will now be listed as follows.

[a] A valve-timing control apparatus for an internal combustion engine, comprising: a drive rotating member (e.g., 1 in the drawings) configured to receive a rotational force from a crankshaft; a driven rotating member (9) fixed to a cam shaft (2) and configured to rotate relative to the drive rotating member (1); an electric motor (12) configured to rotate the driven rotating member (9) relative to the drive rotating member (1) by means of rotary drive of the electric motor (12); a housing (5) connected integrally with the drive rotating member (1), wherein structural components of the electric motor (12) are accommodated in the housing (5); a cover member (3) fixed to a main body of the internal combustion engine and located to face a front end portion of the housing (5); a slip ring (26*a*, 26*b*) configured to supply electric power to the electric motor (12) and provided to one of the front end portion of the housing (5) and a facing portion of the cover member (3) which faces the front end portion of the housing (5); a brush (30*a*, 30*b*) provided to another of the front end portion of the housing (5) and the facing portion of the cover member (3), and configured to supply electric power to the electric motor (12) by an electrical contact with the slip ring (26*a*, 26*b*); a tubular motor output shaft (13) provided inside the housing (5) to be rotatable relative to the housing (5), and configured to be rotated by electric-power supply to the electric motor (12), wherein lubricating oil is supplied into the tubular motor output shaft (13); a bearing member (38) provided between an outer circumferential surface of a part of the driven rotating member (9) and an inner circumferential surface of the tubular motor output shaft (13); a plug member (55) fixed to an inner circumferential surface of a tip portion of the tubular motor output shaft (13), the cover member (3) facing the tip portion of the tubular motor output shaft (13), wherein the plug member (55) is configured to inhibit lubricating oil supplied into the tubular motor output shaft (13) from leaking to an external; and a seal member (50) provided between the cover member (3) and the housing (5) and configured to inhibit lubricating oil from entering a gap between the slip ring (26*a*, 26*b*) and the brush (30*a*, 30*b*), wherein the plug member (55) includes a core member (56) formed in a bottomed tubular shape having a through-hole (56*c*) in a bottom portion of the core member (56), and an elastic body (57) coating at least the through-hole (56*c*) and an outer circumferential surface of the core member (56), the elastic body (57) closing the through-hole (56*c*).

[b] Alternatively, the plug member (e.g., 55 in the drawings) includes a core member (56) formed in a bottomed cylindrical shape having a through-hole (56*c*) in a bottom portion of the core member (56); and a sealing structure configured to maintain a sealed state of the through-hole (56*c*) under a state where the lubricating oil supplied into the tubular motor output shaft (13) takes a maximum pressure level thereof, and to release the sealed state of the through-hole (56*c*) when an axial force greater than the maximum pressure level of the lubricating oil is applied to the through-hole (56*c*).

[c] Further alternatively, the plug member (e.g., 55 in the drawings) is formed in a bottomed cylindrical shape, and a bottom portion (57) of the plug member (55) has a rigidity lower than a rigidity of the other portion (56) of the plug member (55).

[d] The valve-timing control apparatus as described in the item [a], wherein the elastic body (e.g., 57 in the drawings) integrally coats the through-hole (56*c*) and the outer circumferential surface of the core member (56) to continue from the through-hole (56*c*) to the outer circumferential surface of the core member (56).

[e] The valve-timing control apparatus as described in the item [b], wherein the elastic body (e.g., 57 in the drawings) coats whole of the core member (56).

[f] The valve-timing control apparatus as described in the item [e], wherein the elastic body (e.g., 57 in the drawings) coats whole of the core member (56) such that an outer circumferential portion of the plug member (55) is a thickest part of the plug member (55).

[g] The valve-timing control apparatus as described in the item [a], wherein the elastic body (e.g., 57 in the drawings) is made of a rubber material.

[h] The valve-timing control apparatus as described in the item [a], wherein the through-hole (e.g., 56*c* in the drawings) is in a circular shape.

[i] The valve-timing control apparatus as described in the item [a], wherein the core member (e.g., 56 in the drawings) is made of a metal material.

[j] The valve-timing control apparatus as described in the item [a], wherein the cover member (e.g., 3 in the drawings) includes a protruding portion (58) protruding toward the plug member (55) from a surface of the cover member which faces the plug member, and at least a part of a tip of the protruding portion (58) faces at least a part of the core member in an axial direction of the tubular motor output shaft (13).

[k] The valve-timing control apparatus as described in the item [j], wherein an outer diameter of a tip portion of the protruding portion (e.g., 58 in the drawings) is greater than an inner diameter of the through-hole.

[l] A detaching method for the plug member in the valve-timing control apparatus as described in the item [a], the detaching method comprising steps of: inserting a jig through the through-hole by breaking the elastic body (e.g., 57 in the drawings); and detaching the plug member from the inner circumferential surface of the tubular motor output shaft (13) by pulling the inserted jig.

This application is based on prior Japanese Patent Application No. 2012-275226 filed on Dec. 18, 2012. The entire contents of this Japanese Patent Application are hereby incorporated by reference.

The scope of the invention is defined with reference to the following claims.

What is claimed is:

1. A valve-timing control apparatus for an internal combustion engine, comprising:

a drive rotating member configured to receive a rotational force from a crankshaft;

a driven rotating member fixed to a cam shaft and configured to rotate relative to the drive rotating member;

an electric motor configured to rotate the driven rotating member relative to the drive rotating member by means of rotary drive of the electric motor;

a housing connected integrally with the drive rotating member, wherein structural components of the electric motor are accommodated in the housing;

a cover member fixed to a main body of the internal combustion engine and located to face a front end portion of the housing;

a slip ring configured to supply electric power to the electric motor and provided to one of the front end portion of the housing and a facing portion of the cover member which faces the front end portion of the housing;

a brush provided to another of the front end portion of the housing and the facing portion of the cover member, and configured to supply electric power to the electric motor by an electrical contact with the slip ring;

a tubular motor output shaft provided inside the housing to be rotatable relative to the housing, and configured to be rotated by electric-power supply to the electric motor, wherein lubricating oil is supplied into the tubular motor output shaft;

a bearing member provided between an outer circumferential surface of a part of the driven rotating member and an inner circumferential surface of the tubular motor output shaft;

a plug member fixed to an inner circumferential surface of a tip portion of the tubular motor output shaft, the cover member facing the tip portion of the tubular motor output shaft, wherein the plug member is configured to inhibit lubricating oil supplied into the tubular motor output shaft from leaking to an external; and a seal member provided between the cover member and the housing and configured to inhibit lubricating oil from entering a gap between the slip ring and the brush, wherein the plug member includes a core member formed in a bottomed tubular shape having a through-hole in a bottom portion of the core member, and an elastic body coating at least the through-hole and an outer circumferential surface of the core member, the elastic body closing the through-hole.

2. A valve-timing control apparatus for an internal combustion engine, comprising:

a drive rotating member configured to receive a rotational force from a crankshaft;

a driven rotating member fixed to a cam shaft and configured to rotate relative to the drive rotating member;

an electric motor configured to rotate the driven rotating member relative to the drive rotating member by means of rotary drive of the electric motor;

a housing connected integrally with the drive rotating member, wherein structural components of the electric motor are accommodated in the housing;

a cover member fixed to a main body of the internal combustion engine and located to face a front end portion of the housing;

a slip ring configured to supply electric power to the electric motor and provided to one of the front end portion of the housing and a facing portion of the cover member which faces the front end portion of the housing;

a brush provided to another of the front end portion of the housing and the facing portion of the cover member, and configured to supply electric power to the electric motor by an electrical contact with the slip ring;

a tubular motor output shaft provided inside the housing to be rotatable relative to the housing, and configured to be rotated by electric-power supply to the electric motor, wherein lubricating oil is supplied into the tubular motor output shaft;

a bearing member provided between an outer circumferential surface of a part of the driven rotating member and an inner circumferential surface of the tubular motor output shaft;

a plug member fixed to an inner circumferential surface of a tip portion of the tubular motor output shaft, the cover member facing the tip portion of the tubular motor output shaft, wherein the plug member is configured to inhibit lubricating oil supplied into the tubular motor output shaft from leaking to an external; and a seal member provided between the cover member and the housing and configured to inhibit lubricating oil from entering a gap between the slip ring and the brush, wherein the plug member includes a core member formed in a bottomed cylindrical shape having a through-hole in a bottom portion of the core member, and a sealing structure configured to maintain a sealed state of the through-hole under a state where the lubricating oil supplied into the tubular motor output shaft takes a maximum pressure so level thereof, and to release the sealed state of the through-hole when an axial force greater than the maximum pressure level of the lubricating oil is applied to the through-hole.

3. A valve-timing control apparatus for an internal combustion engine, comprising:

a drive rotating member configured to receive a rotational force from a crankshaft;

a driven rotating member fixed to a cam shaft and configured to rotate relative to the drive rotating member;

an electric motor configured to rotate the driven rotating member relative to the drive rotating member by means of rotary drive of the electric motor;

a housing connected integrally with the drive rotating member, wherein structural components of the electric motor are accommodated in the housing;

a cover member fixed to a main body of the internal combustion engine and located to face a front end portion of the housing;

a slip ring configured to supply electric power to the electric motor and provided to one of the front end portion of the housing and a facing portion of the cover member which faces the front end portion of the housing;

a brush provided to another of the front end portion of the housing and the facing portion of the cover member, and configured to supply electric power to the electric motor by an electrical contact with the slip ring;

a tubular motor output shaft provided inside the housing to be rotatable relative to the housing, and configured to be rotated by electric-power supply to the electric motor, wherein lubricating oil is supplied into the tubular motor output shaft;

a bearing member provided between an outer circumferential surface of a part of the driven rotating member and an inner circumferential surface of the tubular motor output shaft;

a plug member fixed to an inner circumferential surface of a tip portion of the tubular motor output shaft, the cover member facing the tip portion of the tubular motor output shaft, wherein the plug member is configured to inhibit lubricating oil supplied into the tubular motor output shaft from leaking to an external; and a seal member provided between the cover member and the housing and configured to inhibit lubricating oil from entering a gap between the slip ring and the brush, wherein the plug member is formed in a bottomed cylindrical shape, and a bottom portion of the plug member has a rigidity lower than a rigidity of the other portion of the plug member.

4. The valve-timing control apparatus as claimed in claim 1, wherein the elastic body integrally coats the through-hole and the outer circumferential surface of the core member to continue from the through-hole to the outer circumferential surface of the core member.

5. The valve-timing control apparatus as claimed in claim 2, wherein the elastic body coats whole of the core member.

6. The valve-timing control apparatus as claimed in claim 5, wherein the elastic body coats whole of the core member such that an outer circumferential portion of the plug member is a thickest part of the plug member.

7. The valve-timing control apparatus as claimed in claim 1, wherein the elastic body is made of a rubber material.

8. The valve-timing control apparatus as claimed in claim 1, wherein the through-hole is in a circular shape.

9. The valve-timing control apparatus as claimed in claim 1, wherein the core member is made of a metal material.

10. The valve-timing control apparatus as claimed in claim 1, wherein the cover member includes a protruding portion protruding toward the plug member from a surface of the cover member which faces the plug member, and at least a part of a tip of the protruding portion faces at least a part of the core member in an axial direction of the tubular motor output shaft.

11. The valve-timing control apparatus as claimed in claim 10, wherein an outer diameter of a tip portion of the protruding portion is greater than an inner diameter of the through-hole.

12. A detaching method for the plug member in the valve-timing control apparatus as claimed in claim 1, the detaching method comprising steps of:

inserting a jig through the through-hole by breaking the elastic body; and detaching the plug member from the inner circumferential surface of the tubular motor output shaft by pulling the inserted jig.

* * * * *